US008561954B2

(12) United States Patent
Padilla

(10) Patent No.: US 8,561,954 B2
(45) Date of Patent: Oct. 22, 2013

(54) COMBINED LADDER ENGAGEABLE TOOL CARRIER AND STEP STOOL

(76) Inventor: Richard Padilla, Bakersfield, CA (US)

( * ) Notice: Subject to any disclaimer, the term of this patent is extended or adjusted under 35 U.S.C. 154(b) by 0 days.

(21) Appl. No.: 13/588,972

(22) Filed: Aug. 17, 2012

(65) Prior Publication Data

US 2013/0043358 A1 Feb. 21, 2013

Related U.S. Application Data

(60) Provisional application No. 61/524,700, filed on Aug. 17, 2011.

(51) Int. Cl.
*E06C 7/14* (2006.01)
*B65D 85/28* (2006.01)

(52) U.S. Cl.
USPC ..... 248/238; 206/373; 182/122

(58) Field of Classification Search
USPC ..... 206/372, 373; 248/210, 238, 311.2; 182/120, 121, 122, 129
See application file for complete search history.

(56) References Cited

U.S. PATENT DOCUMENTS

| | | | | | |
|---|---|---|---|---|---|
| 3,976,163 | A * | 8/1976 | Watkinson | ..... | 182/20 |
| 5,052,581 | A * | 10/1991 | Christ et al. | ..... | 220/570 |
| 5,123,620 | A * | 6/1992 | Bourne | ..... | 248/210 |
| 5,333,823 | A * | 8/1994 | Joseph | ..... | 248/146 |
| 5,749,437 | A * | 5/1998 | Weller | ..... | 182/129 |
| 5,782,314 | A * | 7/1998 | Zeitler | ..... | 182/129 |
| 5,941,344 | A * | 8/1999 | Spadaro | ..... | 182/129 |
| 5,950,972 | A * | 9/1999 | Irish | ..... | 248/210 |
| 5,988,383 | A * | 11/1999 | Armstrong | ..... | 206/373 |
| 6,148,958 | A * | 11/2000 | Ahl et al. | ..... | 182/129 |
| 6,564,941 | B2 * | 5/2003 | Hedges | ..... | 206/373 |
| 7,195,119 | B2 * | 3/2007 | Lungo | ..... | 206/373 |
| 2005/0150723 | A1 * | 7/2005 | Wilson et al. | ..... | 182/129 |
| 2012/0217093 | A1 * | 8/2012 | Latimer et al. | ..... | 182/129 |

* cited by examiner

*Primary Examiner* — Jacob K Ackun
(74) *Attorney, Agent, or Firm* — Donn K. Harms

(57) ABSTRACT

A tool carrying device configured for removable engagement atop a stepladder and to provide elevated support for a user when the carrying device is positioned on the ground. A secure removable engagement with the top of the ladder is provided by walls descending from a top which form a skirt to surround the top end of the ladder and hold the device from sliding therefrom. Removable tool holders and shelves to hold and store tools are provided, allowing the user a secure tool box when atop a ladder and a slightly elevated working structure for tasks requiring a lower elevation for the user.

16 Claims, 3 Drawing Sheets

COMBINED LADDER ENGAGEABLE TOOL CARRIER AND STEP STOOL

BACKGROUND OF THE INVENTION

1. Field of the Invention

This application claims priority to U.S. Provisional Application Ser. No. 61/524,700 filed on Aug. 17, 2011 and incorporated in its entirety by reference thereto.

The present invention relates generally to tool containers and holders. More particularly, the disclosed device relates to a multi-function tool carrier providing, in one preferred as-used engaged mode, a ladder-engageable tool holder/container, and in a second preferred mode, a combined step stool and tool holder/container.

2. Prior Art

Service and maintenance industries including construction, demolition, plumbing, electrical, landscaping, janitorial, and the like conventionally require workers to use and thus carry many hand tools and other equipment through their workday. Conventional methods for the transport, carry, and organization of tools include tool boxes, belts, buckets, bags, packs and various others containers.

The typical tool belt provides a convenient means to carry tools on a user's body which can save quite a bit of time and effort when changing tools. The tool belt is often the most desired choice of carrying means by workers since it allows them to maintain most, if not all, needed tools close by and at all times. However, if a user has many tools, the belt can become heavy and undesirably bulky, and possibly interfere with the job at hand. As such, the tool belt which is a device that was meant to help with the job is merely interfering and slowing down the user.

Alternatively, the typical tool box provides a rigid box-like structure for containing tools and other equipment, and often employing a carrying handle and lockable lid. Such devices may be preferred for larger or more expensive equipment wherein the user may desire to lock the tools within for safe keeping. Further, although a tool box will similarly become quite bulky and heavy given a plurality of tools, a user will typically place the tool box in one location on a work site and simply return to the box as needed to acquire the correct tool.

However, while constant retrieving relieves the problem of carrying a plurality of heavy tools on their person, the task of continuously returning to the tool box wastes time, especially if an incorrect tool was chosen accidentally, or if the job at hand requires the user to change tools frequently. Further, the conventional tool box is limited to the formed compartments within the interior and is not easily modified to accommodate all types of tools.

As outlined above, conventional tool carrying devices fall short in providing convenient and effective tool carrying methods. These devices further inconvenience should user visits be required if positioning for the task at hand is more involved. Positioning for a particular task adds time to accomplishing the job if the user leaves and returns, such as when a user is working in an elevated position upon a ladder.

Construction and maintenance practices and tasks often require a user to scale a ladder as needed to work on a task at elevations which they cannot comfortably or physically reach from the ground. To comfortably perform a task at an elevated height, a means to elevate the user to the correct working height is required. Ladders are known to vary greatly in size and height and while even employing a ladder at low elevations, a conventional tool belt can become bulky and possibly interfere with safety when atop the ladder. Similarly, since the user cannot carry a heavy tool box in one hand and scale a ladder and perform a task, employing tools from the conventional tool box will require a user to repeatedly scale the ladder to return and retrieve the correct tool. Moving to and from the elevated job position upon the ladder is time consuming and can possibly compromise safety since each trip increases the chance of falling.

As a result, in an attempt to solve this problem, prior art has shown tool carrying devices and containers that are engageable to a ladder. U.S. Pat. No. 5,052,581 to Christ et al. teaches a ladder-supported holding tray providing engagement to a ladder rung. However, the device merely provides a tray surface for paint or alternatively temporarily placing a tool and does not provide means for secured engagement, storage, or transport of various tools as may be desired.

U.S. Pat. Nos. 5,123,620 to Bourne; 5,333,823 to Joseph; and 5,950,972 to Irish teach detachable carrying containers providing engagement to the top platform of a conventional stepladder. These devices, however, are limited either by providing only a single tray or compartment or alternatively only a limited quantity of tools receiving cavities.

These, as well as other prior art tool containers, further fall short in that they lack utility required on a jobsite in that they only accomplish the task of holding or containing tools and equipment. As a result, the prior art devices themselves only add to the clutter of components a user or handyman already owns.

As such, there is a continuing and unmet need for a multi-function ladder engageable tool carrying device that additionally serves other purposes. Such a device should alleviate the need to carry tools and other items on a tool belt when climbing or situated atop a ladder in order to reduce hazards associated with such. Such a device should not require screws, clamps or other means of engagement to the ladder but should be easily engageable by a simple placement over the top platform of a conventional folding ladder. Such a device when in the engaged position atop the ladder, should not interfere with the stepping portion of the ladder.

Still further, such a device should be formed of rigid material such that in a secondary as-used mode, the device can replace a ladder for lower positioned jobs and tasks and can be employed on the ground or other support surface as a combination step stool and tool holder/container. In either position, in order to minimize the need to move between the job at hand and a tool box, such a device should comprise one or a combination of containers, compartments, holders, shelves, and the like as needed to organize, store, and permit transport of the device and operatively held tools for the intended task.

The forgoing examples of related art and limitation related therewith are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The device herein disclosed and described provides a solution to the shortcomings in prior art and achieves the above noted goals of multi-function and time saving through the provision of a multi-function tool container which can function in a first ladder engageable position as well as function to replace the ladder and function as a step stool for lower positioned tasks. Briefly, the device is formed of a rigid wall structure and includes sections employing one or a combination of shelves, compartments, holders, and containers for engaging, organizing, securing, and storing various tools and equipment thereto.

In a first preferred as used mode, which provides the user a stationary positioning for tools and the like at an elevated job height, the device is adapted for a simple non-attachment engagement over the top platform of a conventional folding step ladder. In this first mode, engaged upon the top platform and held in place by gravity and a skirt surrounding the platform, the device provides a hand accessible container for tools to be used, thus eliminating the need for a user to employ a tool belt when working atop the ladder. Since a number of tools may be held by the device engaged on the ladder, climbing of the ladder for tool retrieval once situated for the task at hand is eliminated or minimized.

In a second preferred as-used mode, the device provides a means for elevating the user for slightly elevated tasks where a ladder may previously have been employed. In such use, the device can be placed on the ground or support surface, and function as a combined tool holder and step stool. The top surface of the device is supported by sidewalls in an elevated position thereby providing a secure platform on a rigid structure formed to withstand the weight of a user.

In accordance with at least one preferred mode, the device includes a body portion defined by a plurality of rigid sidewalls, and a top surface. The body portion also has an exterior surface and an interior chamber or cavity having one or a plurality of tool supporting shelves therein.

The sidewalls defining the internal cavity of the device are preferably shaped to form a skirt with a wider mouth portion leading to the narrower top platform. This results in an interior surface of the skirt or sidewalls, configured at an angle adapted to match that of the top two legs of a ladder adjacent to the ladder platform. So configured with the narrowing skirt provides a means for engaging the device over the top platform of a conventional folding stepladder in a manner in which it is prevented from sliding and disengaging therefrom, but with no mechanical attachments such as screws, bolts, or clamps.

A conventional folding stepladder generally includes two halves formed by legs which are in a hinged engagement at a top portion with the ladder top platform. Such ladders can be unfolded to the as-used configuration formed to an inverted "V" shape, and held in place at a fixed angle. At least one half of this inverted V includes a climbing or stepping portion defined by several sequential stepping rungs engaged between two legs of the ladder half. Generally, the other half portion of the ladder includes structural supports not conventionally intended for supporting the weight of climbing user.

As noted the prior art ladder shelving uses clips, screws, and members and the like which must be engaged to the ladder while elevated. Such a time consuming engagement is eliminated in the device herein because engagement to the ladder may be accomplished by a simple lifting the mouth of the skirt formed by sidewall surrounding the top surface, up and over the top platform of the ladder. Then the device is simply lowered such that either the sidewalls of the skirt engage with the two vertical edges of the two halves of the ladder, and/or the lower side of the top surface of the device rests on the top step or platform of the ladder. Removal is a simple reverse of this action. During use, the top surface of the device rests on the top platform of the ladder, or it may rest slightly above it should the angle of the ladder halves cause a frictional engagement withing the skirt.

As such, in the first preferred as-used mode, the device is slidably engageable over the top of a ladder and requires no attachment components and rests in seated engagement upon the top platform of the ladder, or the surface of the two halves adjacent to the top surface, or both. Lateral movement horizontally and dismount is prevented by the skirt formed by the sidewalls which extend downward. The device is, thus, securely mounted atop the ladder in a manner which it will not dismount unless it is lifted by the user back over the top platform of the ladder.

In at least one other preferred mode of the device, the sidewall positionable adjacent and substantially parallel to the stepping side of the ladder, includes an aperture therein. This aperture provides a means for foot or hand access to the upper rung of the ladder so as to allow the user to access the stepping rung at or near the top platform. Similarly, the sidewall adjacent to the stepping side of the ladder can be omitted entirely to reduce weight, yet maintain structural rigidity and make mounting on a ladder easier. In this mode, means to prevent a sliding of the ladder through the open section is provided using a lip extending below the top of the device on the open side.

In another mode of the invention, the top surface of the device is employed as a bottom surface of a compartment component. As such a plurality of sidewalls extending opposite to those forming the skirt may extend around the peripheral edge of the top surface of the structure to define the storage compartment. There may be included a rotatably engaged lid portion employing a means for securement in the horizontal position to allow the user to close the compartment, and if desired, lock the lid in the closed position.

Further, the interior cavity may include a rotatably engaged shelf component that provides an additional compartment for transporting and storing tools and a platform for resting or placing tools atop. It is preferred that this shelf include an interior compartment defined by a bottom wall and a plurality of sidewalls. There is additionally included a rotatably engaged lid portion which may be closed with tools inside during transport, mounting, and dismounting. As such the shelf component provides both a storage compartment portion, and tool resting platform, when the lid is closed.

It is preferred that the shelf is rotatably engaged within the interior cavity of the device and therefor positionable to an upright substantially vertical position such as not to interfere with the engagement of the device over the ladder. Subsequent to engaging the device over the top of the ladder in the first as-used mode, the shelf can be rotated downward and supported substantially horizontal in an elevated useable position by any supporting means known in the art, such as flexible stays formed of cable or chain or polymer members and the like.

In yet another particularly preferred as-used mode, the top surface of the lid of the shelf may align in the horizontal plane with the step rung below the top platform, such that the step rung can provide an extension of the top surface of the shelf component. Alternatively, in another preferred mode, the shelf in the horizontal employable position, may have a lower surface rest on top of the step rung immediately below the top platform. This provides a means for supporting the shelf in the horizontal employable position, and eliminating the need for supporting the shelf using the cable stays.

The exterior surface of the skirt formed by the sidewalls of the device further include one or a plurality of means for removable engagement of tools or tool holding components. The tool holding components can be operatively shaped canvas pouches, rigid containers, or cavities engaged or generally formed on the exterior surface. In a particularly preferred mode, the tool holding components are removably engaged to the exterior surface by a means for removable engagement, such as but not limited to tab and slot type engagement, magnets, hooks, or clips. However, it is noted and anticipated that in other preferred modes of the invention, the tool holding components can be permanently engaged to the exterior surface such as by welding, riveting, screwing, or other suitable mechanical fastener.

It is particularly preferred that the tool holding components are individually formed to receive specific tools. However, the holding components can be any shape as needed for receiving and holding any type of tool and other equipment. For example, a particularly preferred tool holding component can be a substantially planar tray body, such as a paint tray for receiving paint, or simply provide a platform to rest tools on.

The device as noted is also employable as a step stool to replace the need for a ladder for lower elevation tasks which require elevation of the user to perform. The rigid sidewalls forming the skirt provide support for the top surface as to allow a user a supporting platform atop the device and elevated above the ground. Thus, for lower elevation tasks where the user needs elevation they may stand upon the top surface.

This means for an elevated support for the user to stand upon provides added utility which is especially advantageous over prior art. It allows the user to employ the device as a step stool to reach slightly elevated work areas instead of a large bulky ladder. Concurrently, it provides a means for carrying tools for use during the task. However, if for some reason the user is subsequently required to employ a folding stepladder, the device can then be easily engaged over the top of the stepladder in the first as-used mode as described, with no tools or mounting components needed.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

It is an object of the invention to provide a ladder engageable tool holding device which will also function as a step stool, and concurrently provide tool transport and storage in one or a combination of shelves, compartment, tool holders, and tool containers.

It is a further object of the invention to provide means for removable engagement of tool holding components or tools, to the exterior of the device.

It is still another object of the invention to provide a tool holding device with an interior cavity employing a rotatably engageable shelf element for additional storage.

These and other objects, features, and advantages of the invention will be brought out in the following part of the specification, wherein detailed description is for the purpose of fully disclosing the invention without placing limitations thereon.

BRIEF DESCRIPTION OF DRAWING FIGURES

The accompanying drawings, which are incorporated herein and form a part of the specification, illustrate some, but not the only or exclusive, examples of embodiments and/or features. It is intended that the embodiments and figures disclosed herein are to be considered illustrative rather than limiting. In the drawings.

DETAILED DESCRIPTION OF THE PREFERRED EMBODIMENTS OF THE INVENTION

Figure 1:
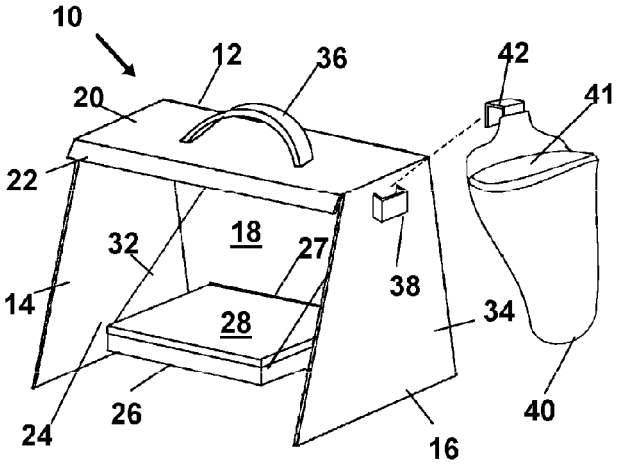
FIG. 1 shows an elevated view of a particularly preferred mode of the device without a front wall portion, also showing a disengaged pouch style removably engageable tool holding member and inner shelf component in the deployed position.

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Now then, referring to drawings in FIGS. 1-12, wherein similar components are identified by like reference numerals, there is seen in FIG. 1 an perspective view of a preferred mode of the device 10 which is employable as a step stool. As shown in FIG. 1, the device 10 in this mode when employed as a step stool, is placed on ground or other support surface where a step stool is desired. The sidewalls provide a rigid structure for the top wall 20 which provides a platform for supporting a users weight in an elevated position. In this mode, the device 10 is generally formed of a rigid durable sheet material such as steel, stainless steel, or aluminum or of a rigid polymer or plastic material. Further, it should be noted that all the various components of all modes of the device disclosed herein can be formed of conventional materials such as metal or plastic or other polymeric materials formed in a suitable manner for the purposes set forth in this disclosure.

In the mode of FIG. 1, the device 10 consists generally of a rigid body structure 12 defined in a particularly preferred mode by a first sidewall 14, a second sidewall 16, a rear wall 18, and a top wall 20, forming the structure as shown in the drawings. The two sidewalls and rearwall in this mode combine to form a three-sided skirt section. The walls this skirt section further define are an interior chamber or cavity 24 and exterior surface 34 of the skirt or side portion of the structure 12. In this mode meant primarily for low level support of the user, the structure 12 is preferable open at the front and at a mouth defined by bottom faces of the three walls, to provide access to the interior cavity 24 and to allow the device 10 to be operatively engaged over the top of a ladder if desired, as will be set forth shortly.

A forward-extending and descending lip 22 is provided as an extension from the top wall 20. The lip 22 extends at a downward angle from the horizontal top wall 20 thereby placing the distal edge of the lip 22 lower than the top wall 20. This configuration provides an opening employable as a means for engaging the top wall 20 over the edge of the top platform (FIG. 8) of the ladder, to the operatively engaged first as-used mode atop the ladder. One skilled in the art will immediately recognize that descending lip 22 component provides a means for preventing sliding of the device 10 in a direction away from the lip 22 when engaged upon the ladder, thereby preventing a dismount from a ladder given a sudden or jarring movement that may be encountered. Other means for prevention of translation and dismount from the ladder through the open side may be employed, and are anticipated, however the downward protruding lip 22 provides an excellent means for such securement in this mode and allowing the other three sides of the skirt, to prevent sliding dismount in directions opposite their respective positions. In this mode of the device 10 of FIG. 1, the user need not lift the device 10 higher than the lowest distal edge of the lip 22 during the elevation and mounting upon the top of the ladder. It is thus easier to engage than the mode of the device 10 having four walls forming the skirt section descending from the top wall 20.

Additional utility is provided by a rotatably engaged shelf component 26 located within the interior 24 of the structure 12. The shelf component 26 further includes a lid 28 providing access to an interior compartment 30 (FIG. 5) as needed to contain various small tools or hardware. The shelf 26 is preferably rotatably engaged to the interior surface of the rear wall 18 by a means of rotational engagement such as a hinge 27. The hinge 27 allows the shelf 26 to store into a substantially upright vertical position as needed to engage the device 10 over a ladder as will be set forth shortly in FIG. 7. Further, the as used substantially horizontal position of the shelf 26 as shown is provided by cable stays 32, however those skilled in the art will appreciate other means to maintain the shelf 26 as such.

Further, the device 10 provides the user with means removable secure engagement of a plurality of various tools. Many prior art devices such as tool boxes or tool belts include tool holding components or compartments which are permanently engaged to a belt, thereby limiting the user to the number and variety of tools that can be carried. However, the present invention employs means for removable mounting or engagement of various tool holding components 40. Currently this removable engagement is provided by cooperative fasteners such as a slot 38 and tab 42 style removable engagement. However, the means for removable engagement may be magnets, hooks, hook and loop fasteners, plastic fasteners, or other means for removable engagement that would be easily known to one skilled in the art. Further, it is noted and anticipated that the means for engagement may be permanent such as by welding, screws, rivets, or the like.

As is shown in the current figure, a particularly preferred tool holding component 40 is shown as in the form of a canvas pouch 41 which is dimensioned in a manner to cooperatively receive a hand drill or similarly shaped tool therein. Such as canvas pouch 41 may be similar to one found permanently engaged to a conventional tool belt (not shown). However, it is within the scope of the invention to employ any tool holding component 40 which has an operative removable engagement and is dimensioned to hold any shape and type of tool and consequently should not be considered limiting by the depictions.

As such the tool holding component 40 can employ any cooperative removable engagement fastener adapted to engage a likewise cooperative fastener of the device, and can be any type pouch, bag, container, pocket, hook, fastener, carrier, or strap of nearly any shape and form as needed to receive and contain any shape and form of conventional tools known in the art and are anticipated in this disclosure. It is the cooperative removable fastener system allowing means for engagement of any of a plurality of tool holding components 40 to be engaged upon the device as needed which provides particular utility since the user may engage the tool and tool holding component 40 and later change to an alternate tool and tool holding component 40 should a different task require a different tool. During use, the tool is securely engaged within arms reach. Given the wide variety of tools and other devises used in construction, it is therefor not possible within this disclosure to disclose each and every form of the tool holding component 40, however those skilled in the art will recognize these.

As such, one skilled in the art will appreciate the variety of shapes and forms of conventional tools known in the art, such as those shown in the SEARS catalog, with a complimentary holding component 40 needed to contain them, are anticipated within the scope of this patent. Further, any cooperative fasteners to removably engage the holding component 40 such as fasteners shown in the 2011 GRAINGER catalog, as would occur to those skilled in the art are also anticipated within the scope of this patent. Further, the tool holding component in other modes may be of a more rigid material such as a polymeric material, textiles, or metal.

The device 10 is further depicted having a handle 36 shown engaged to the top wall 20. However, it is within the scope of the invention that the handle 36 be engaged to any wall of the device 10, such as the rear wall 18 or another wall forming the descending skirt, which would keep the top wall 20 unobstructed and more desirable during employment as a step stool.

In general the device 10 includes mounting mating fasteners to allow for an engagement of one or a plurality of tool holding components 40. As shown for purposes of operation, the mating cooperative fasteners may be tab elements 42 for cooperative removable engagement with slot elements 38 engaged or otherwise formed on the exterior surface 34 of the body structure 12.

Figure 2:
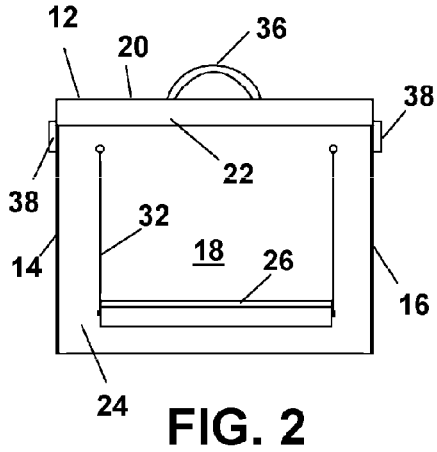
FIG. 2 shows a front view of the device of FIG. 1 with tool holding member omitted.
Figure 3:
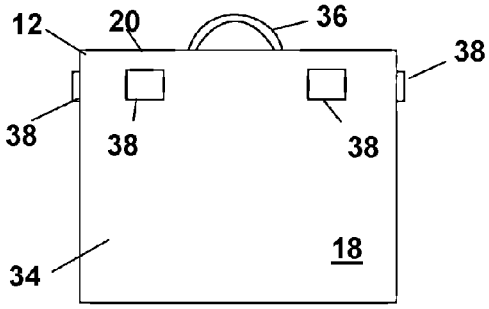
FIG. 3 is a rear view of the device of FIG. 1.
Figure 4:
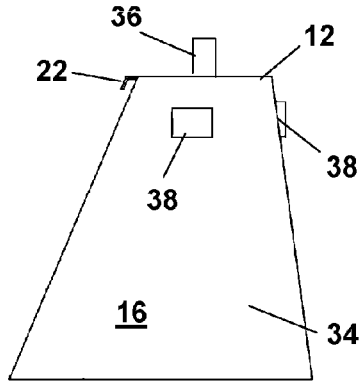
FIG. 4 is a side view of the device of FIG. 1 with the tool holding member omitted.

As is shown in the front, rear, and side views of FIG. 2, FIG. 3, and FIG. 4 respectively, the device 10 preferably includes a plurality of mating fasteners such slot members 38 which allow any one or a plurality of tool holding components 40 to be removably and securely engaged to the device. Again noting that those skilled in the are will recognize that the means for removable engagement of the tool holding components 40 to the exterior 34 of the structure 12 may alternatively be magnets, hooks, hook and loop fasteners, or any mating fastener from the GRAINGER or similar catalog, or other means known in the art, while the tab and slot arrangement is shown merely as a particularly preferred mode.

Figure 5:
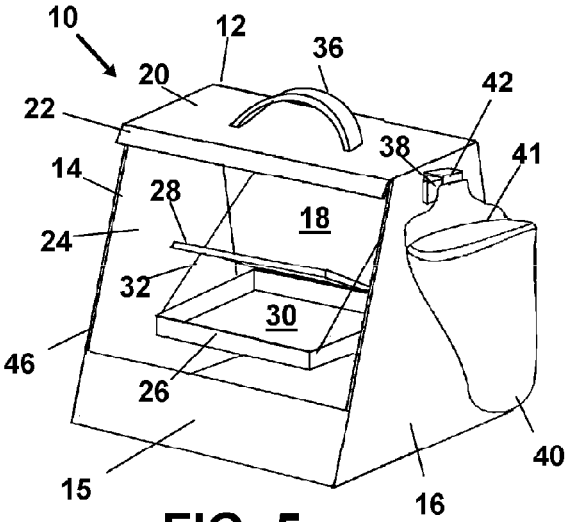
FIG. 5 is an elevated view of another particularly preferred mode of the device with a partial front wall portion, showing the pouch style removably engageable tool holding member in the engaged position.

An additional particularly preferred mode of the device 10 is shown in FIG. 5 wherein the body structure 12 includes a partial front wall portion 15 of the formed skirt, communicating between the first sidewall 14 and second sidewall 16 preferably along the bottom edge defining the mouth of the skirt section. In this manner the front of the device 10 is configured with a partial front wall 15 and formed aperture 46 thereabove providing arms length access to the interior cavity 24 of the structure 12 when engaged upon a ladder. The bottom of the sidewalls forming the skirt structure is maintained open and defining a mouth of the skirt. Also, as is shown more clearly in this current figure, a lid 28 of the shelf component 26 is depicted as in the open mode wherein the interior compartment 30 is accessible by reaching through the aperture.

Figure 6:
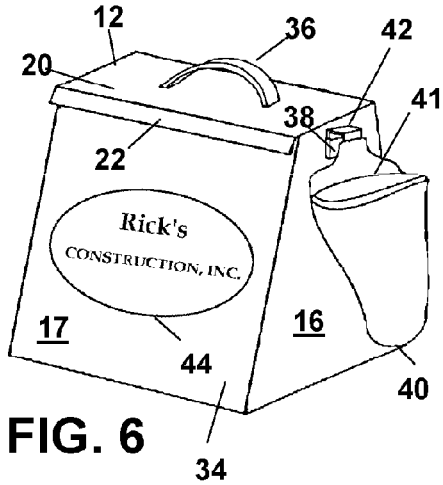
FIG. 6 is an elevated view of yet another particularly preferred mode of the device with a full front wall portion including indicia, also showing the pouch style removably engageable tool holding member in the engaged position.

A still further particularly preferred mode of the device 10 is shown in FIG. 6. In this mode the body structure 12 further defines an aperture covering front wall 17. In this manner the device 10 would not include the shelf component 26 as in this mode the interior cavity 24 is only accessible through the mouth section at the lower end of the skirt formed by the four walls. This mode may be preferred if the shelf component 26 is not desired and a particularly secure engagement atop the ladder is desired and which is provided by the four sided skirt descending well below the top of the ladder. Additional utility is found in that the exterior 34 of the front wall 17 may provide as a display means for advertisement such as the employment of indicia 44 of a company logo, for example. Further, the device 10 may be personalized individually with a user's personal indicia 44 as desired.

Figure 7:
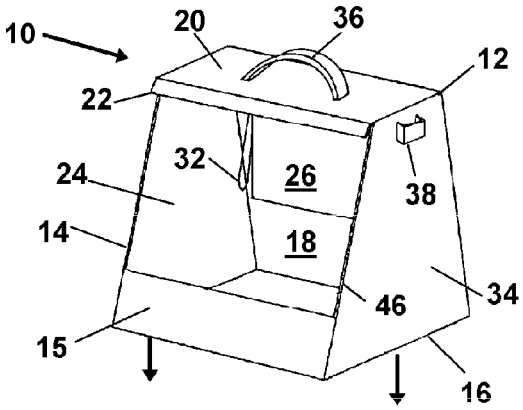
FIG. 7 is an elevated view of the device of FIG. 5 prior to operative engagement over a ladder with the inner self component in the stored, substantially upright position.
Figure 7:
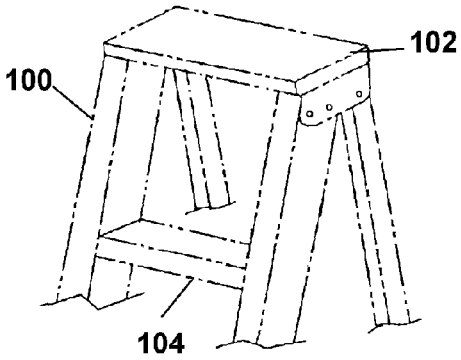

As mentioned previously in this disclosure, a user may often employ a ladder in order to reach elevated work areas which has been shown to cause difficulties for employment of the conventional tool belt or tool box. As such the device 10 provides a solution in that it may be operatively securely engaged over a conventional stepladder 100 without the need for fasteners or screws, or clamps and the like. Shown in FIG. 7 is a partial view of a conventional "A" shaped stepladder 100 including top platform 102 and also showing the top stepping rung 104.

Figure 8:
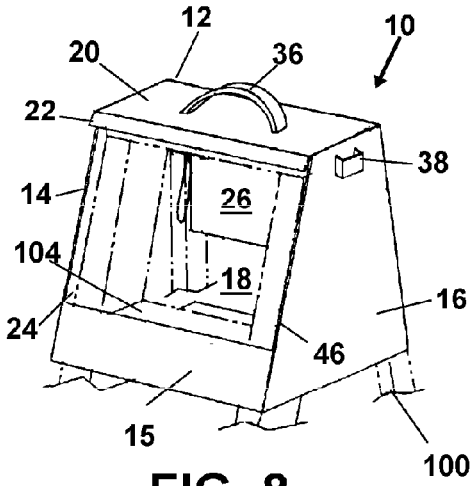
FIG. 8 is a view of the device in operative engagement over a ladder with the inner self in the stored mode.

As can be further seen in the figure, prior to engagement of the device 10 over the top platform 102 of the ladder 100, the shelf component 26 if present, may be rotated to a substantially upright or vertical stored-position as needed. In the stored position, the interior cavity 24 can easily receive the top of the ladder 100. FIG. 8 shows the device 10 in an operative engagement over the ladder 100 wherein the top wall 20 of the structure 12 rests atop the top platform 102. If the ladder has too wide of a stance, the skirt formed by the sidewalls may engage against the edges of the four legs of the ladder.

As can be further seen, the top lip 22 descends below and substantially hooks around one edge of the top platform 102 providing means for securement of the device 10 to the ladder 100 to prevent a sliding of the ladder through the formed front aperture 46. Further, it is particularly preferred that the front aperture 46 is formed with a perimeter defining an area large enough to provide a means for the user to access the top stepping rung 104 with their foot or hands, as intended during conventional employment of the ladder 100. This allows the user to step on the top run en route to an position higher than the top of the ladder if need be.

It must be noted that although the figures showing operative engagement of the device 10 with the ladder 100 depicts the mode of FIG. 5, the mode of FIGS. 1-4, 6, 11, and 12 may similarly employed as such. The mode shown in FIG. 1 will ensure that the top stepping rung 104 is unobstructed no matter the location of the rung 104 relative the top platform 102.

Figure 9:
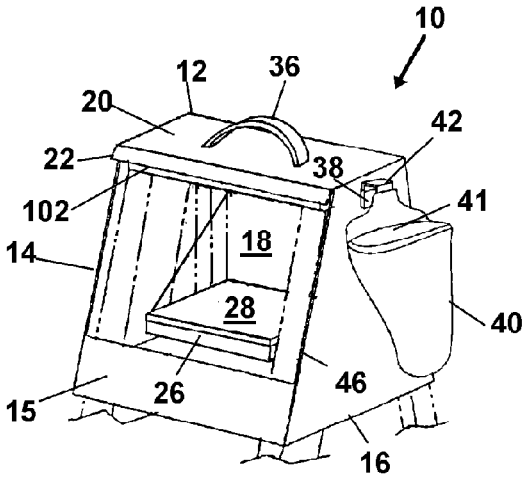
FIG. 9 is a view of the device in the as used mode in operative engagement over a ladder with the inner self in the deployed position.

The first as-used mode of the device 10 atop a ladder, is shown in FIG. 9 with the shelf component 26 in the as used substantially horizontal position and showing at least one tool holding component 40 removably engaged to the exterior 34 of the structure 12. It is particularly preferred that the shelf 26 in the as used horizontal position be of sufficient length whereby at least a distal edge rests on a portion of the top stepping rung 104 of the ladder. This will allow the user to temporarily place tools or other equipment on the shelf 26 without compromising the integrity of the cable stays 32. This further allows the user to more easily access the lid 28 as needed to retrieve or replace hardware from the interior compartment 30.

Figure 10:
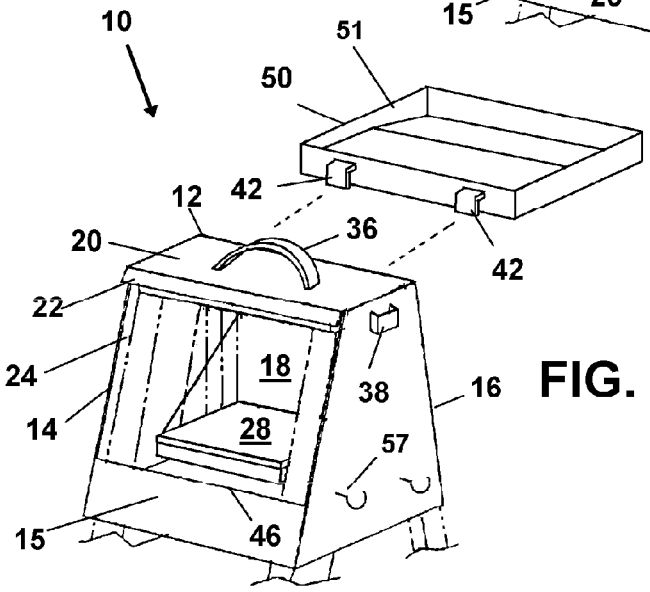
FIG. 10 shows a view of the device with an additional particularly preferred tool holding member such as paint tray.

As is shown in the as used mode of FIG. 10, the device 10 may additionally include a removably engaged platform or tray 51 such as may be needed for holding paint and similar supplies. The tray 50 employs tab elements 42 for removable engagement to slots 38 on the exterior 34 of the rear wall 18 as was shown previously in FIG. 3. However the tray 51 may employ any means for removable engagement known in the art. Further shown are optional preferred hooks 57 providing additional means for removable engagement of tools or other equipment.

Figure 11:
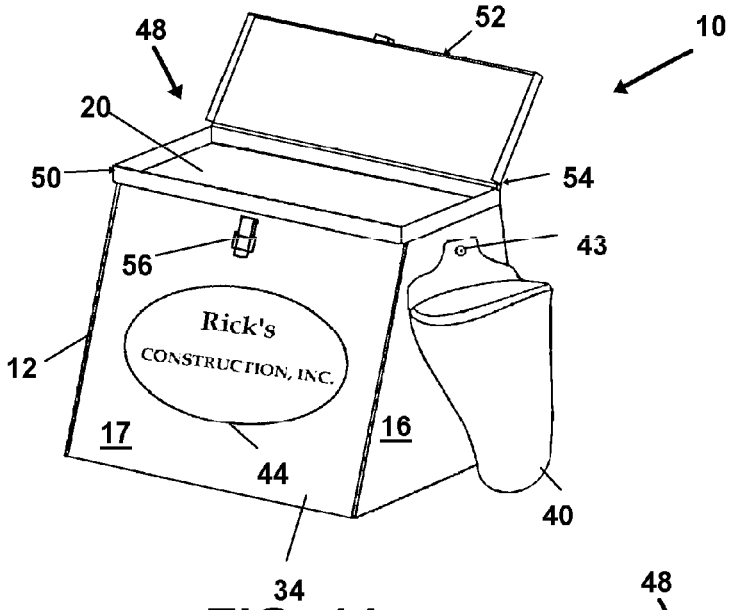
FIG. 11 shows a view of yet another particularly preferred mode of the device employing a top compartment for additional tool storage.
Figure 12:
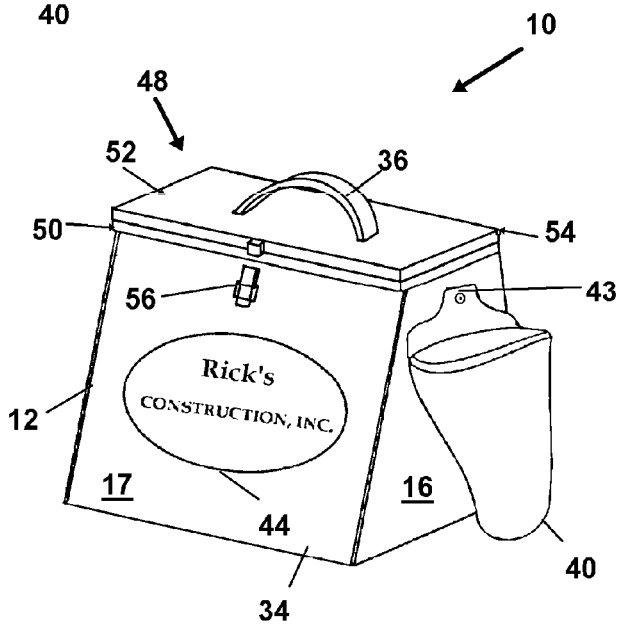
FIG. 12 shows the mode of the device of FIG. 11 with the lid of the top storage compartment in the closed position.

FIG. 11 and FIG. 12 show yet another preferred components in another mode of the device 10 which includes a top storage compartment 48. In this mode, the top surface 20 of the structure 12 comprises a bottom surface of the compartment 48. In addition, there can be seen a plurality of sidewalls 50 extending vertically around the peripheral edge of the top surface 20 to form a confined area for storage and means to prevent a sliding of a tool or stored item from the top of the ladder.

There is also shown a rotatably engaged lid portion 52 providing a means for closure of the compartment 48 for secure storage or transport of items therein without worry they will fall from the device during transport. The means for rotatable engagement may be a hinge 54 or the like. Further a handle 36 is shown engaged to exterior of the lid 52, however could alternatively be engaged to the back wall 18 as chosen by the designer.

A lid securement or locking fastener 56 is also provided to secure the lid 52 in the closed position. The fastener 56 may be any conventional securing or locking fastener or latch known in the art, for example an over center locking latch, or a latch adapted to receive a security lock or a hook and loop.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed:

1. A tool carrying device comprising:

a support structure said support structure having a top wall;

a skirt section engaged at a first end with said top wall, said skirt section formed by a first side wall opposite a second side wall and having a rear wall communicating therebetween;

said skirt section extending a length from said first end to a distal edge defining a mouth opening;

an interior cavity defined by an area between said top wall and said skirt section and said mouth opening;

first edges of said first sidewall and said second sidewall adjacent to said top wall having a first length;

second edges of said first side wall and said second side wall having a second length;

said second length being longer than said first length thereby defining said cavity having a cavity dimension wider at a cavity area adjacent to said mouth opening than at a second cavity area adjacent to said top wall;

said cavity dimension providing means for a complimentary engagement of said tool carrying device over a top end of a stepladder which is in a upright position with its lower end positioned upon a support surface;

said tool carrying device positionable to a first as-used position with said tool carrying device in said complimentary engagement with said ladder and said skirt extending a distance away from said top end of said stepladder toward said support surface whereby said skirt provides means for preventing a sliding dismount of said tool carrying device from said ladder;

an opening between said top wall, said first side wall and said second sidewall, said opening positioned opposite said rear wall;

said opening providing access to rungs on said ladder for a foot or hand of a user when said tool carrying device is in said complimentary engagement;

said tool carrying device positionable to a second as-used position, with said mouth adjacent to or in contact with said support surface and said top wall elevated thereabove a distance determined by said length of said skirt section; and said tool carrying device in said second as-used position providing an elevated support platform to support a user thereon said distance above said support surface.

2. The tool carrying device of claim 1, additionally comprising:

a lip portion extending from a first edge of said top wall adjacent to said opening and opposite said rear wall;

said lip portion extending to a distal end positioned lower than a top surface of said top wall; and said lip providing means for prevention of a sliding of said ladder through said opening when said tool carrying device is in said first as-used position atop said ladder.

3. The tool carrying device of claim 1, additionally comprising:

an exterior surface having one or a plurality of first cooperative fasteners, said first cooperative fasteners configured for a complimentary cooperative engagement with second cooperative fasteners upon tool holders;

one or a plurality of said tool holders from a group of tool holders including pouches, bags, containers, pockets, hooks, fasteners, carriers, and straps; and said tool holders removably engageable to said exterior surface using said second cooperative fastener thereon thereby providing means for temporary engagement of a tool to said tool carrying device.

4. The tool carrying device of claim 2, additionally comprising:

an exterior surface having one or a plurality of first cooperative fasteners, said first cooperative fasteners configured for a complimentary cooperative engagement with second cooperative fasteners upon tool holders;

one or a plurality of said tool holders from a group of tool holders including pouches, bags, containers, pockets, hooks, fasteners, carriers, and straps; and said tool holders removably engageable to said exterior surface using said second cooperative fastener thereon thereby providing means for temporary engagement of a tool to said tool carrying device.

5. The multi-function tool carrying device of claim 1 further comprising:

a partial front wall communicating between said first sidewall and second sidewall and covering a portion of said opening;

said front wall defining an aperture formed in said opening; and said aperture providing means for access of the hand or foot of a user to said interior cavity.

6. The multi-function tool carrying device of claim 2 further comprising:

a partial front wall communicating between said first sidewall and second sidewall and covering a portion of said opening;

said front wall defining an aperture formed in said opening; and said aperture providing means for access of the hand or foot of a user to said interior cavity.

7. The multi-function tool carrying device of claim 4 further comprising:

a partial front wall communicating between said first sidewall and second sidewall and covering a portion of said opening;

said front wall defining an aperture formed in said opening; and said aperture providing means for access of the hand or foot of a user to said interior cavity.

8. The multi-function tool carrying device of claim 5 further comprising:

a partial front wall communicating between said first sidewall and second sidewall and covering a portion of said opening;

said front wall defining an aperture formed in said opening; and said aperture providing means for access of the hand or foot of a user to said interior cavity.

9. The multi-function tool carrying device of claim 1 further comprising:

an interior shelf positioned within said interior cavity;

said interior shelf having a stored position substantially vertical and adjacent to said rear wall;

said interior shelf having a deployed position horizontally disposed when said multi-function tool is in said first as-used position;

said interior shelf in said stored position providing a clear pathway through said interior cavity during a positioning of said multi function tool to said complimentary engagement over said top end of said stepladder; and said interior shelf moveable to said deployed position subsequent to an achievement of said complimentary engagement, whereby said shelf may hold tools and other objects accessible by a user through said opening.

10. The multi-function tool carrying device of claim 2 further comprising:

an interior shelf positioned within said interior cavity;

said interior shelf having a stored position substantially vertical and adjacent to said rear wall;

said interior shelf having a deployed position horizontally disposed when said multi-function tool is in said first as-used position;

said interior shelf in said stored position providing a clear pathway through said interior cavity during a positioning of said multi function tool to said complimentary engagement over said top end of said stepladder; and said interior shelf moveable to said deployed position subsequent to an achievement of said complimentary engagement, whereby said shelf may hold tools and other objects accessible by a user through said opening.

11. The multi-function tool carrying device of claim 3 further comprising:

an interior shelf positioned within said interior cavity;

said interior shelf having a stored position substantially vertical and adjacent to said rear wall;

said interior shelf having a deployed position horizontally disposed when said multi-function tool is in said first as-used position;

said interior shelf in said stored position providing a clear pathway through said interior cavity during a positioning of said multi function tool to said complimentary engagement over said top end of said stepladder; and said interior shelf moveable to said deployed position subsequent to an achievement of said complimentary engagement, whereby said shelf may hold tools and other objects accessible by a user through said opening.

12. The multi-function tool carrying device of claim 4 further comprising:

an interior shelf positioned within said interior cavity;

said interior shelf having a stored position substantially vertical and adjacent to said rear wall;

said interior shelf having a deployed position horizontally disposed when said multi-function tool is in said first as-used position;

said interior shelf in said stored position providing a clear pathway through said interior cavity during a positioning of said multi function tool to said complimentary engagement over said top end of said stepladder; and said interior shelf moveable to said deployed position subsequent to an achievement of said complimentary engagement, whereby said shelf may hold tools and other objects accessible by a user through said opening.

13. The multi-function tool carrying device of claim 5 further comprising:

an interior shelf positioned within said interior cavity;

said interior shelf having a stored position substantially vertical and adjacent to said rear wall;

said interior shelf having a deployed position horizontally disposed when said multi-function tool is in said first as-used position;

said interior shelf in said stored position providing a clear pathway through said interior cavity during a positioning of said multi-function tool to said complimentary engagement over said top end of said stepladder; and said interior shelf moveable to said deployed position subsequent to an achievement of said complimentary engagement, whereby said shelf may hold tools and other objects accessible by a user through said aperture.

14. The multi-function tool carrying device of claim 6 further comprising:

an interior shelf positioned within said interior cavity;

said interior shelf having a stored position substantially vertical and adjacent to said rear wall;

said interior shelf having a deployed position horizontally disposed when said multi-function tool is in said first as-used position;

said interior shelf in said stored position providing a clear pathway through said interior cavity during a positioning of said multi function tool to said complimentary engagement over said top end of said stepladder; and said interior shelf moveable to said deployed position subsequent to an achievement of said complimentary engagement, whereby said shelf may hold tools and other objects accessible by a user through said aperture.

15. The multi-function tool carrying device of claim 7 further comprising:

an interior shelf positioned within said interior cavity;

said interior shelf having a stored position substantially vertical and adjacent to said rear wall;

said interior shelf having a deployed position horizontally disposed when said multi-function tool is in said first as-used position;

said interior shelf in said stored position providing a clear pathway through said interior cavity during a positioning of said multi function tool to said complimentary engagement over said top end of said stepladder; and said interior shelf moveable to said deployed position subsequent to an achievement of said complimentary engagement, whereby said shelf may hold tools and other objects accessible by a user through said aperture.

16. The multi-function tool carrying device of claim 8 further comprising:

an interior shelf positioned within said interior cavity;

said interior shelf having a stored position substantially vertical and adjacent to said rear wall;

said interior shelf having a deployed position horizontally disposed when said multi-function tool is in said first as-used position;

said interior shelf in said stored position providing a clear pathway through said interior cavity during a positioning of said multi function tool to said complimentary engagement over said top end of said stepladder; and said interior shelf moveable to said deployed position subsequent to an achievement of said complimentary engagement, whereby said shelf may hold tools and other objects accessible by a user through said aperture.

* * * * *